United States Patent [19]

Johnson

[11] Patent Number: 4,712,734

[45] Date of Patent: Dec. 15, 1987

[54] LOW-INTENSITY INFRARED HEATING SYSTEM WITH EFFLUENT RECIRCULATION

[76] Inventor: Arthur C. W. Johnson, 2611 Lake Charnwood, Troy, Mich. 48084

[21] Appl. No.: 860,859

[22] Filed: May 8, 1986

[51] Int. Cl.[4] ..... F24H 3/00; F24C 3/00

[52] U.S. Cl. ..... 237/70; 126/91 A

[58] Field of Search ..... 237/70; 126/92 AC, 91 A, 126/391; 165/49

[56] References Cited

U.S. PATENT DOCUMENTS 3,115,302 12/1963 Corey .
3,313,288 4/1967 Aho ..... 126/391
3,825,406 7/1974 Heath .
3,994,665 11/1976 Young .
4,422,573 12/1983 Morgan ..... 237/70
4,429,830 2/1984 Forster et al. ..... 122/20 B X
4,582,042 4/1986 Kubler ..... 237/70 X

*Primary Examiner*—Henry A. Bennet
*Attorney, Agent, or Firm*—Krass & Young

[57] ABSTRACT

A relatively low temperature, low-intensity infrared heating system in which at least a substantial portion of the effluent in the emitter tube is recirculated and mixed with the hot effluent from the burner of burners to produce a uniform system temperature. A relatively long low-temperature exhaust leg is utilized to increase thermal efficiency. The burner or burners receive combustion air from outside the enclosure and valves are used to prevent reverse flow.

18 Claims, 8 Drawing Figures

LOW-INTENSITY INFRARED HEATING SYSTEM WITH EFFLUENT RECIRCULATION

INTRODUCTION

This invention relates to low-intensity infrared heating systems of the type wherein a burner is used to introduce a hot gaseous effluent into an emitter tube which extends through the area to be heated and more particularly to a system which is typified by relatively low and uniform emitter temperatures produced by effluent recirculation.

BACKGROUND OF THE INVENTION

Low-intensity infrared heating systems comprise one or more burners feeding hot gaseous effluent into an emitter tube which, as a result of the heat of the effluent, emits energy in the infrared range. When used in combination with a suitable reflector, and typically, but not necessarily, placed overhead in a building structure, such as a warehouse or production area the low-intensity infrared system provides efficient, comfortable and highly effective heating through directionalized or focussed radiation. The effectiveness of such systems in providing comfort derives from a number of factors including the ability to direct the radiation to relatively specific areas where it is needed and desired and also from the fact that humans and animals feel more comfortable at lower air temperatures when expose to radiant heat than when they are in higher temperature air heated and circulated by a conventional furnace. Additionally, the concrete floors of industrial and agricultural buildings absorb radiation from the emitter tube and thereafter release heat at floor level. The result is substantially lower cost of operation and increased comfort to persons working in the area and, in some agricultural, horticultural and commercial applications such as greenhouses, hog barns and chicken coops, increased continued growth and shorter incubation times which also results in lower costs.

The temperature of the emitter tube and, hence, the magnitude of the radiation produced thereby, typically varies from a maximum immediately downstream of the burner to a minimum at the exhaust. In a prior art system, the maximum or inlet temperature may be on the order of 1000° F. and the low or exhaust temperature may be about 170° F. The minimum temperature is preferably selected to be high enough to avoid condensation of acids within the system thereby to prevent corrosion at or near the exhaust end.

Because of the high temperature gradient, i.e., about 830° F., along the emitter tube and the relatively high temperatures often needed near the input end to achieve system capacity specifications, it is often necessary to provide large spacings between the emitter tube and such things as combustible building materials and fuel tanks to satisfy safety requirements. Moreover, very hot emitters can be uncomfortable to stand under if spacings are under 8 feet or so. Ultimately, the spacing requirement affects building space utilization efficiency; e.g., lower ceilings can reduce construction costs.

One approach to providing a more uniform radiant energy output along the length of the emitter tube is described in my U.S. Pat. No. 4,529,123 issued July 16, 1985, "Radiant Heater System." In that patent I disclosed the use of a ceramic insert near the burner end of the tube to reduce tube temperature and effectively transfer energy downstream in the system.

SUMMARY OF THE INVENTION

In accordance with my invention I provide an infrared heating system of the type comprising an emitter tube, at least one burner for introducing a hot gaseous effluent into the emitter tube and a reflector which is associated with at least the majority of the working length of the tube to directionalize the emitted radiation. In addition, I arrange the emitter tube to define a recirculation path for the effluent and exhaust therefrom only a portion of the recirculating effluent such that the majority of the hot gaseous effluent is recirculated through the tube. This creates a flywheel effect which tends to render the temperature relatively uniform over the entire operating length of the primary emitter tube. I place one or more burners outside of the tube, using outside air for combustion, and, in the case of multiple burners, feeding effluent into the emitter tube at spaced points to maintain temperature uniformity. As such, the hotter effluent of the burners is immediately mixed with the cooler recirculated effluent to average emitter temperature down.

Because the effluent is recirculated, I find that I can utilize in many cases relatively high output burners in such a system; i.e. the high temperature effluent from a burner, combustion air for which is brought from outside the enclosure, is immediately mixed with the cooler recirculating effluent and tube surface temperatures remain relatively low and the levels of temperature elevation are better controlled throughout the system. Accordingly, it is possible to locate an emitter in a system of the type described herein closer to persons in inhabited work areas and closer to combustible building materials than was previously possible using standard prior art systems. Moreover, it is possible to use a relatively light gage material for the emitter tube, thus saving substantially on construction cost and decreasing warm-up time; i.e., the time lag between burner turn-on and effective energy emission.

In one form of my invention, the emitter tube is formed as a continuous loop, burner entry conduits being placed at intervals therealong. An exhaust conduit extracts the same quantity of effluent admitted by the burners, the major quantity of effluent being recirculated.

In another form of my invention, single length tubes or "sticks" are internally subdivided such as by baffles to produce a recirculation path. Burner effluent introduction and exhaust can be carried out at the same end of the tube giving great flexibility in design and mounting arrangements.

My invention may be best understood by reference to the following description of a specific embodiment thereof.

DETAILED DESCRIPTION OF THE SPECIFIC EMBODIMENT

Figure 1:
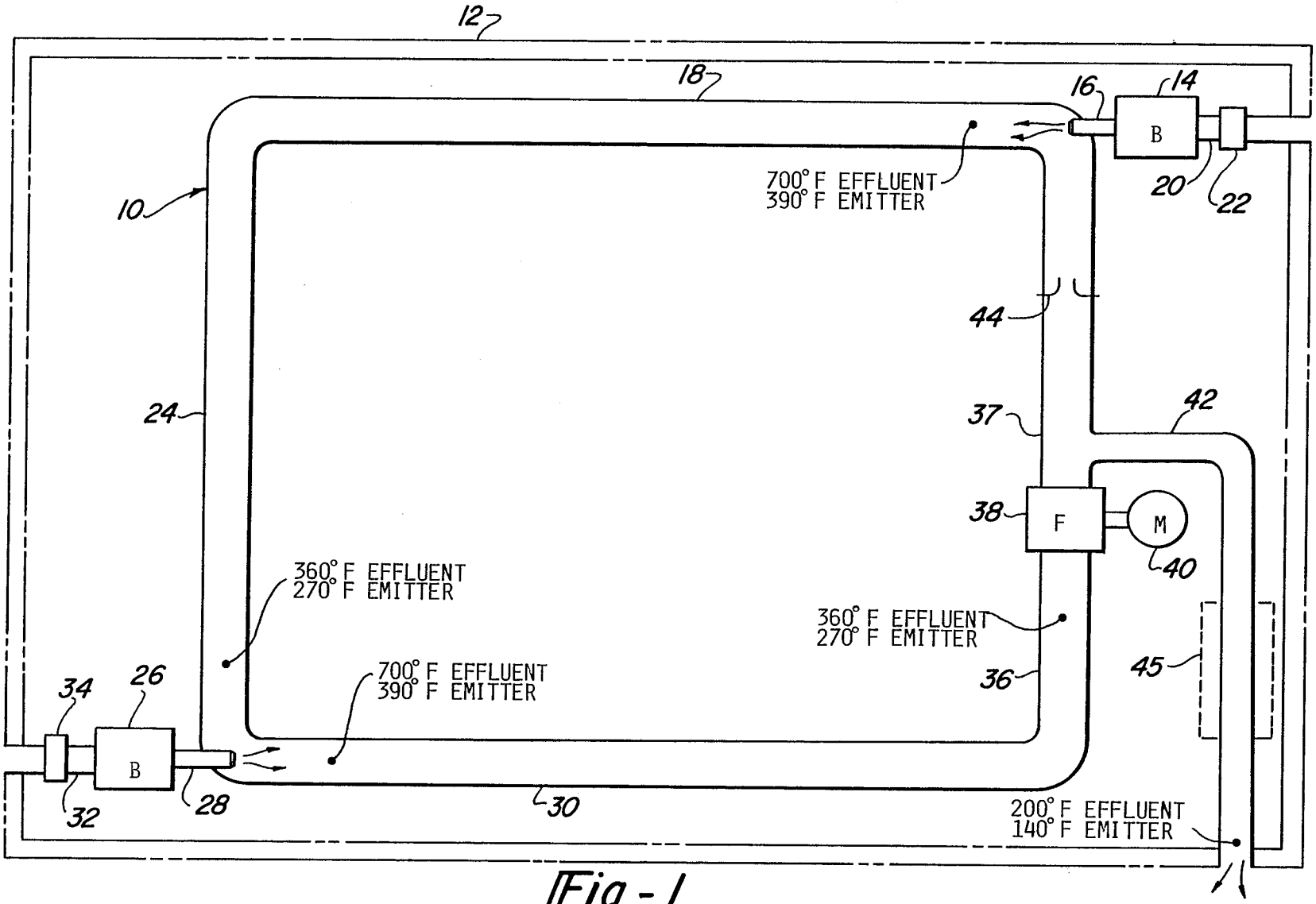
FIG. 1 is a schematic diagram of a low-intensity radiant-energy heating system embodying the principles of the present invention.

Referring to FIG. 1, an emitter tube 10 of approximately six inch to fifteen inch diameter and configured in a closed loop for recirculation purposes is located overhead within an enclosure represented by outside walls 12. It is to be understood that the shape of the enclosure, the closed tube loop, and the relative proportions between the enclosure 12 and the emitter tube 10 will vary according to need and the illustration of FIG. 1 is not to be construed as either typical or to appropriate scale.

The system of FIG. 1 comprises a first burner 14 which may, for example, be a natural gas-fired burner of approximately 4,000 to 400,000 BTU capacity having an outlet conduit 16 connected into the emitter 10 to direct a 700° to 300° F. effluent directly downstream in the emitter leg 18. Burner 14 is connected to receive outside air through pipe 20 having therein a combination flap valve and damper 22 to prevent reversal of air flow from the emitter tube 10 and through the burner, and to adjust total air flow.

The effluent from burner 14 flows counterclockwise or from right to left through leg 18 as shown in FIG. 1 and from top to bottom through the contiguous leg 24 of emitter 10. At the end of leg 24 a second burner 26, similar or identical to burner 14, is connected into the system such that burner output tube 28 is directed downstream in a leg 30 of emitter 10. Burner 26 receives outside air for combustion through inlet tube 32 which has operatively placed therein a combination flap valve and damper 34.

Leg 30 is connected into contiguous leg 36 containing a fan 38 for creating air movement within the system. Fan 38 is driven by motor 40. Immediately downstream of fan 38 leg 36 is connected into a Tee 37 out of which the exhaust leg 42 extends toward an opening in the outside of the outside wall 12. Obviously the exhaust leg 42 may also extend upwardly toward the ceiling, the particular arrangement of the exhaust leg 42 depending on available space and also upon efficiency and condensate drainage considerations hereinafter described.

In the system using only a negative draft inducer, an orifice device 44 is connected in the leg 36 downstream of the fan 38 and downstream of the exhaust leg 42 to balance system flow and provide a pressure drop which promotes flow through the burner 14 and outlet tube 16 into the leg 18 of the emitter tube 10.

Describing for purposes of example an illustrative system, emitter tube 10 is constructed of six inch diameter spiral-wrapped 22-gage aluminized or galvanized steel tube and/or coated materials to vary emmisivity rates having a crimped and reinforced mechanical seam. Other tube systems could be used to less advantage. This unusually light and effective emitter tube material, which may be as light as 31-gage, 0.010 inch to 0.012 inch exhibits a weight-to-surface area ratio of about one or less and is preferred for use in connection with the present system in view of the low-temperature operating conditions obtained through the use of the principles and implementations of the present invention. Burner 14 is a 4,000 to 400,000 BTU/HR burner of the type available from the Combustion Research Corporation of Pontiac, Mich., assignee of the present patent. The effluent temperature at the outlet of the burner is close to 2500° F. and is approximately at or near stoichometer air:fuel ratio. This hot effluent is mixed with recirculated effluent to provide a 700° F. mixture and, because of the mixing of cooler recirculated effluent, the tube temperature immediately downstream of the burner 14 heat transfer tube surface is approximately 390° F.

Leg 18 is approximately 40 feet in length and carries an average of 385 cubic feet per minute of effluent. Assuming leg 24 is 30 feet in length, the temperature of the effluent immediately upstream of burner 26 is approximately 360° F. and the temperature of the emitter tube 10 in the same area is approximately 270° F. for a total emitter tube temperature variation of only 120° F. in nearly 70 feet of high volume operating length. This is in dramatic contrast to the temperature variation of 800° F. which characterized the prior art system described in the introduction hereof. The result is a dramatic increase in temperature uniformity, a dramatic compression of average temperature, and an increase in use and comfort in the heated total floor area of the building enclosure.

Burner 26 is also a 4,000 to 400,000 BTU burner of the type available from the Combustion Research Corporation of Pontiac, Mich. Leg 30 is 40 feet in length and carries an average of 468 cubic feet per minute of effluent for a typical 105,000 BTU/hr burner. Leg 36 is also 30 feet in length overall. Effluent and emitter tube temperatures immediately downstream of burner 26 are identical to the temperatures immediately downstream of burner 14. The effluent temperature immediately upstream of the fan 38 is 360° F. and the emitter tube temperature is 270° F. Although FIG. 1 of the drawing shows the hot fan 38 approximately midway in the total length of leg 36, it is actually expected to be much closer to the burner 16, the proportions of the drawing being varied for convenience and clarity only. As mentioned earlier, the single fan system can be replaced with a multiple burner system, either positive or negative.

The exhaust leg 42 will carry approximately 140 cubic feet per minute on the 105,000 two burner system described and is approximately 50 feet long and may be constructed of 3½ inch diameter tubing because of the substantially lower flow capacity which is required therein relative to the flow capacity of the much larger diameter tube 10. Of course flow capacities can be regulated by means of dampers as well as tube diameters. The output effluent temperature where the exhaust reaches the atmosphere is to be 200° F. and the emitter temperature is down in the range of 150° to 170° F., just above the condensation temperature. As stated, exhaust leg 42 and heat exchanger 45 are preferably fabricated from non-corrodable materials such as stainless steel, coated steel, plastic and/or metallized plastic and can be designed to echaust at lower temperatures to use latent heat; temperatures of 34° F. (to avoid freezing problems) have been achieved using outside air.

The long exhaust leg 42 release a great deal of thermal energy into the enclosure bounded by walls 12 and thus substantially increases the overall thermal efficiency of the system shown in FIG. 1. Fans and fin-type heat exchangers 45 as well as cross-flow heat exchangers may be utilized to distribute the thermal energy which is recovered from the exhaust leg 42 as will be apparent to those skilled in the art. It is believed to be clear that the total volume of flow through exhaust leg 42 equals the sum of the flow through inlet tubes 20 and 32 and that substantially 75% of the total effluent in the closed loop emitter tube 10 is recirculated while only 25% is exhausted through leg 42. However, this percentage can be controlled to suit the application.

Figure 2:
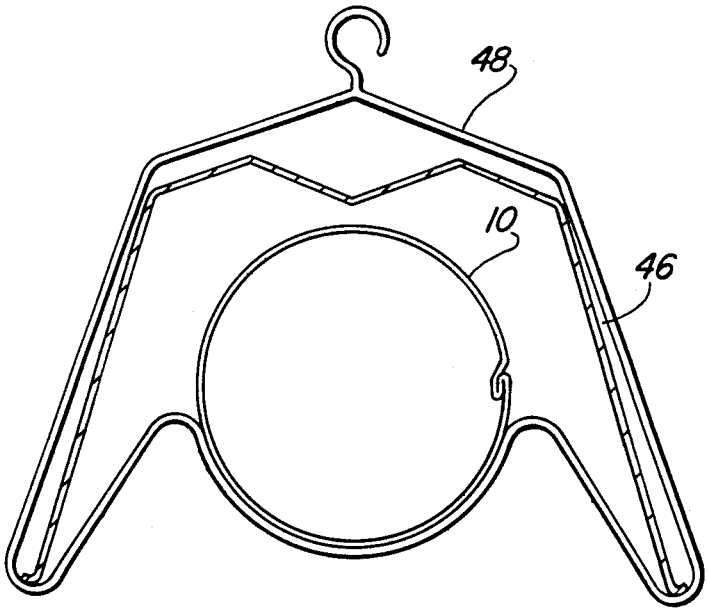
FIG. 2 is a cross-sectional view of a representative portion of an emitter tube showing the association of the reflector and hanger elements therewith.

FIG. 2 illustrates the association between the tube 10 and a stamped metal reflector 46 which extends over the tube 10 throughout its operating length. A wire or strap-type hanger 48 interconnects the tube 10 and the reflector 46 and provides a convenient means for locating the physical elements of the system overhead in the enclosure or area to be heated.

Figure 3:
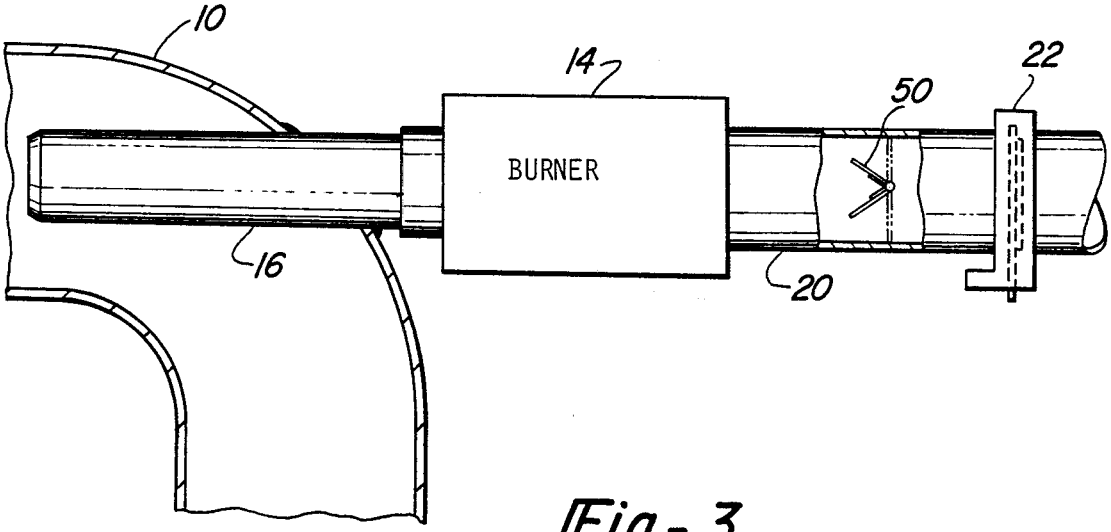
FIG. 3 is a detail of the connection of a burner into an emitter tube.

FIG. 3 illustrates the physical manner in which the outlet of pipe 16 of the burner 14 is connected into the emitter tube 10. A welded type of connection is believed to be preferable. A butterfly-or poppet-type flap valve 50 having a very light spring so that air flow is capable of opening the valve is provided immediately upstream of the burner 14 in the inlet of tube 20. The damper 22 is adjacent the valve 50 for fine tuning the system for balance as previously described. The valve 50 prevents any reverse flow into the exhaust leg 42 and back through the burner 14 immediately after the system shut off. This is particularly important where the exhaust outlet point is lower than the burner inlet point and convection causes the hot effluent to back up through the system as soon as the fan 38 is shut off. If this is allowed to occur, the hot effluent can overheat the burners and damage wiring and other physical components thereof. The closure of the damper results in additional fuel savings and maintenance of flame safety and ignition electrodes.

Figure 4:
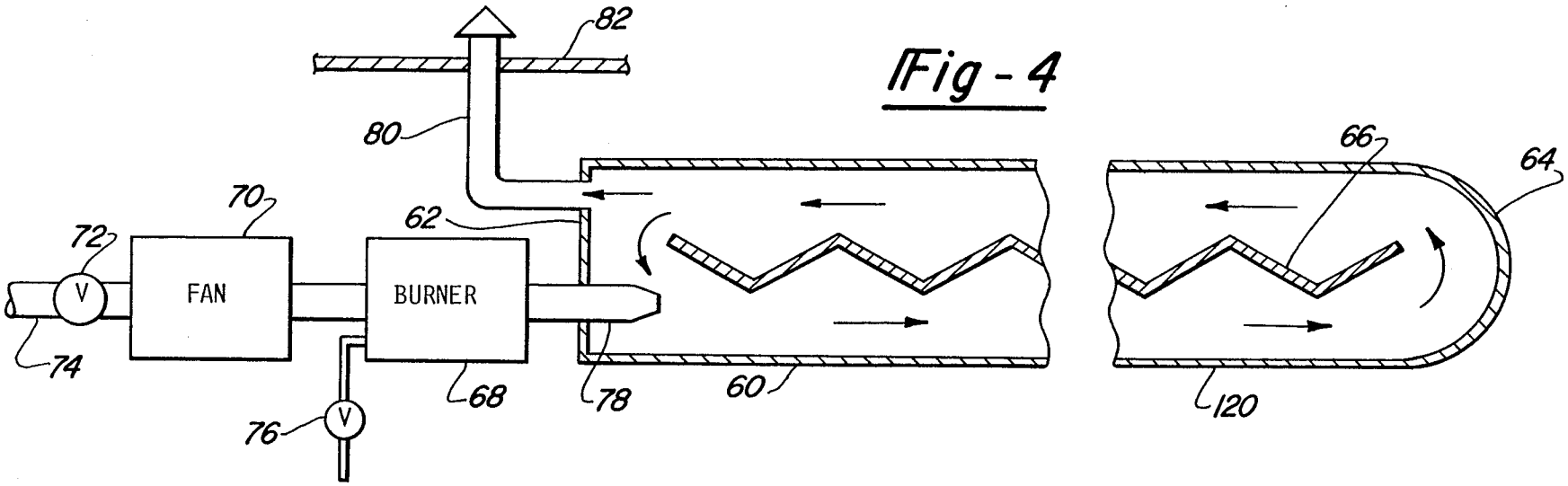
FIG. 4 is a partially sectioned view of an embodiment using an internally divided emitter tube.
Figure 6:
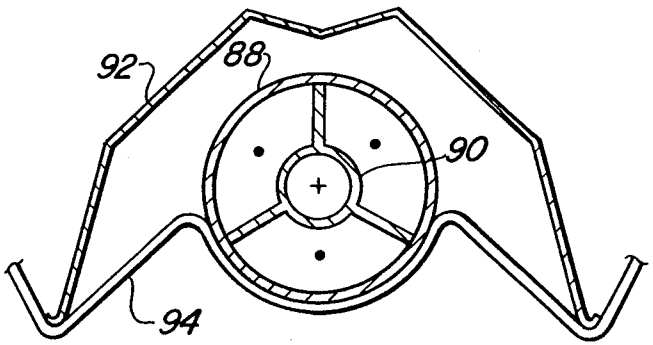
FIGS. 5 and 6 are end views of alternative internal tube subdivision arrangements.
Figure 5:
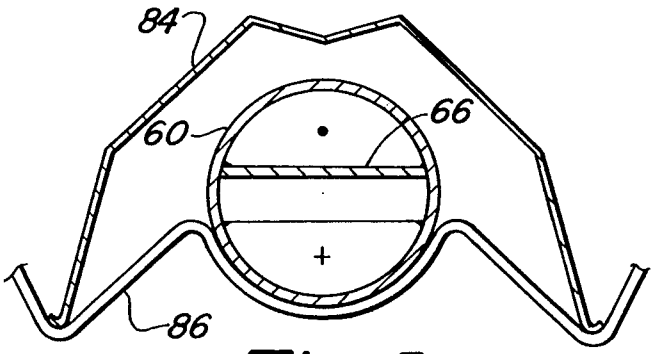

Referring now to FIGS. 4–8, a second embodiment of the invention employing the effluent recirculation principle will be described. Referring specifically to FIG. 4, a cylindrical emitter tube 60, hereinafter sometimes referred to as a "stick" emitter, is fabricated from a high emissivity material, such as steel, to exhibit a blunt left end 62 and a semispherical or domed end 64. The length of the stick emitter 60 can vary according to the desired application; typical lengths are between 5 and 100 feet with diameters on the order of 6 inches to 18 inches. Stick emitter tube 60 is fitted with an internal baffle 66 which essentially divides the tube 60 into a lower outbound channel and an upper inbound channel. Although the baffle 66 is secured to the sides of the tube 60 as shown in FIG. 5, it is spaced inwardly from both ends to provide an effluent recirculation channel which, in this case, runs counterclockwise. A burner 68 receives air under positive pressure from an input fan 70. The fan 70 is connected through a control valve 72 to an outside air supply 74. Gas is supplied through a valve 76 and a suitable gas line such that the burner 68 provides a jet of hot effluent through a nozzle 78 which is mechanically mounted so as to extend into the outbound lower effluent channel of the stick emitter tube 60 as shown. The nozzle provides a high pressure, high speed jet of effluent to establish a recirculation pattern in the stick emitter 60 as indicated by the arrows.

A portion of the effluent is exhausted through exhaust stack 80 which extends through the ceiling 82 of the heated enclosure. As with the closed recirculation embodiment of FIG. 1, a large percentage of the effluent is recirculated to lower the overall tube emitter temperature and render it more uniform over its length.

As indicated in FIG. 5, the emitter tuber 60 is associated with a shroud-like reflector 84, the combination of the reflector 84 and the tube 60 being mounted by means of a plurality of wire hangers 86. The dot and cross convention is used in FIG. 5 to indicate direction of effluent flow. It will be understood that these directions are exemplary only.

The division of the stick emitter tube 60 into outbound and inbound effluent recirculation channels can be achieved numerous ways. The baffle 66 is one practical way, a second division scheme being indicated in FIG. 6. According to the arrangement of FIG. 6, the emitter tube 88 is internally subdivided by means of a concentric inner tube 90 having mounting legs as shown. Again, the emitter tube is associated with a deep shroud-like metal reflector 92 and the combination is mounted overhead in the heated area by means of wire hangers 94.

Figure 7:
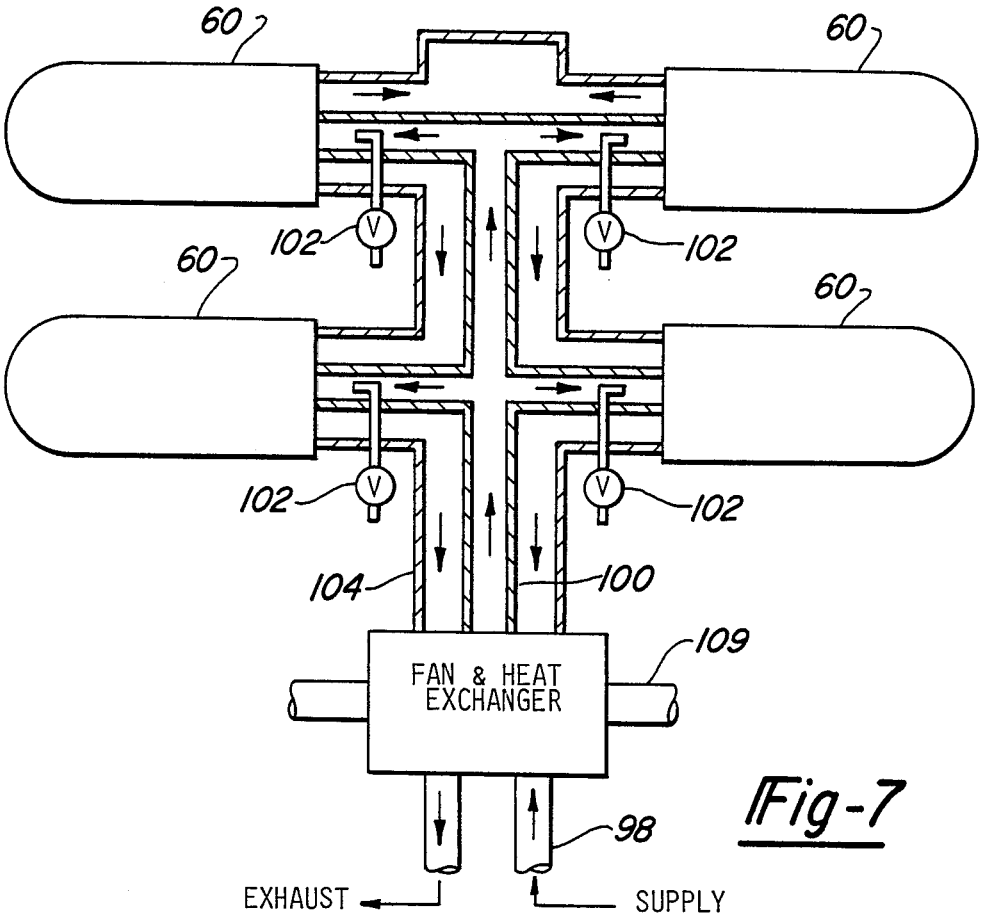
FIG. 7 is a plan view of an arrangement of internally divided tubes for heating a large area.

FIG. 7 illustrates in plan view an arrangement consisting of a plurality of the stick emitters 60 to heat a large building such as livestock housing or an aircraft hanger. In this arrangement, a combination fan and heat exchanger module 96 receives air through supply tube 98 from outside the enclosure and directs the air under positive fan pressure into an internal pipe 100 which extends through branches to the inputs of all of the stick emitter tubes 60 as shown. Each of the emitter tubes 60 is provided with its own burner, this being indicated in FIG. 7 by the gas supply line and valve 102 so as to charge each of the emitters with a hot gaseous effluent which circulates and recirculates according to the arrangement of FIG. 4. Each stick emitter tube 60 has an exhaust which through branches is connected an outer tube 104 which concentrically surrounds the inner tube 100 and directs the exhaust air back to the fan and heat exchanger module 96. To raise system efficiency, the module 96 preferably contains fins and a cross-flow air system 107,109 to extract heat from the exhaust air and direct it into the heated enclosure. The heat exchanger may in fact reduce the temperature of the effluent to condensation temperatures whereby it is possible to recover latent heat. In applications such as greenhouses, the acid condensate can be used for watering by mixing the condensate with ground water or well water and/or by the addition of alkaline materials which are normally used for fungus control. Neutralization devices for industrial heating systems of very high efficiency may also be highly desirable since such systems generate little or no atmospheric pollutants.

The exhaust air at a much reduced temperature is ultimately expelled through vent pipe 106. It is to be understood that each of the stick emitters 60 in the multiple emitter system of FIG. 7 is associated with an appropriate reflector.

Figure 8:
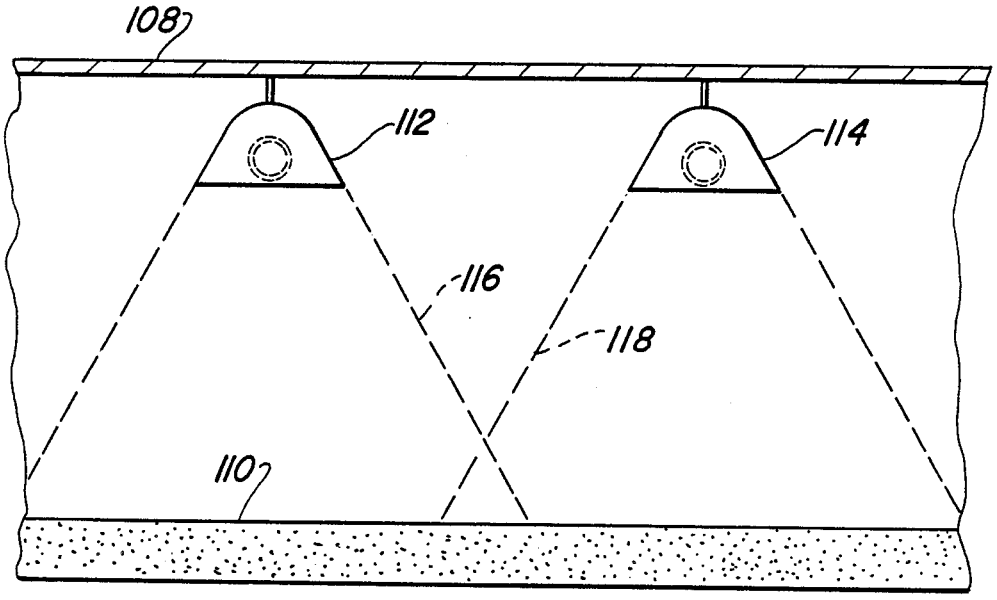
FIG. 8 is a side view of a typical parallel tube system.

FIG. 8 is a schematic diagram of a building 108 having a concrete floor 110 which absorbs the frequencies emitted by low intensity radiant energy heating systems. The emitter tubes are shown in dotted lines within overhead mounted reflectors 112 and 114 which run parallel to one another within the enclosure 108. The emission pattern of reflector 112 is shown to overlap the pattern of reflector 114 so as to maintain a relatively uniform heating effect at the floor level; i.e., since the radiation intensity is proportional to the cosign of the angle between a normal vertical line and the line of incidence, intensity tends to fall off toward the outer fringes of the radiation pattern. Therefore, an overlap of the type shown produces a cumulative heating effect in the area of the overlap, tending to maintain a relatively uniform intensity pattern. Actual spacing is a function of vertical height and reflector angle.

An advantage of the stick-type emitters is the fact that they may be manufactured as prefabricated modules and straightforwardly installed at the construction site with a minimum of sheet metal work.

As indicated in FIG. 4, it may be desirable to apply a coating 120 to the surface of the emitter tube 60 to increase the effective emissivity of the tube. Emissivity coatings which alter the emissivity rating of the underlying construction material are available from a number of sources and may both increase and decrease effective emissivity. Suitable emissivity controlled coatings are available from Solar Energy Corporation of Princeton, N.J.

I claim:

1. A low-intensity infrared heating system comprising:

emitter means defining a continuous loop to circulate effluent introduced therein;

a burner having a combustion chamber with a combustion air input, both said chamber and said input being external to the loop of said emitter means for producing a hot gaseous effluent;

means connecting said burner to said emitter means to introduce said effluent into said emitter means;

an exhaust means connected to said emitter means to exhaust a portion of the circulating effluent;

the mass flow capacity of said emitter tube being substantially greater than the flow capacity of said exhaust means whereby at least a substantial portion of the effluent passes said exhaust means and recirculates through said loop.

2. Apparatus as defined in claim 1 wherein said means connecting said burner to said tube includes a nozzle located in a manner which allows the cooler recirculating effluent to mix with the hotter effluent from said burner in order to maintain an essentially uniform temperature throughout said tube.

3. Apparatus as defined in claim 1 further including fan means associated with said emitter means in the area of said exhaust means for promoting recirculation through said loop and through said exhaust means.

4. Apparatus as defined in claim 3 further including means disposed between said exhaust means and said burner for producing a pressure drop in said loop.

5. Apparatus as defined in claim 1 further including valve means mounted in said burner input for supplying combustion air to said burner from outside said enclosure, but preventing the hot effluent from flowing in reverse from the emitter means through said burner.

6. Apparatus as defined in claim 1 further including:

a second burner separate from the loop configuration of said tube for producing a hot gaseous effluent; and means connecting said second burner to introduce the effluent therefrom into said loop at a position which is spaced from said first burner.

7. Apparatus as defined in claim 6 wherein said means connecting said burner to said loop is located in a manner which allows the cooler recirculating effluent to mix with the hotter effluent from said burner in order to maintain an essentially uniform temperature throughout said loop.

8. Apparatus as defined in claim 1 wherein said emitter means is a tube made of a light gage metal having a weight-to-surface area ratio of approximately one or less.

9. Apparatus as defined in claim 8 wherein said emitter tube is of spiral-wrapped construction.

10. Apparatus as defined in claim 1 further including infrared wavelength reflector means associated with at least a portion of the working length of said emitter means for directing the electromagnetic radiation therefrom.

11. Apparatus as defined in claim 1 wherein means are provided for connecting a source of combustion air to said burner from outside said enclosure and said supply means further include an air-operated valve to prevent reverse flow through said burner to the outside air.

12. Apparatus as defined in claim 1 wherein said exhaust means comprises a relatively substantial length of emitter tube within the area to be heated, said length being chosen to lower the temperature of the effluent at the end of said exhaust means to a point sufficient to condense at least a portion of said effluent.

13. Apparatus as defined in claim 12 wherein said exhaust means possesses heat exchanging means.

14. Apparatus as defined in claim 12 wherein at least a portion of said exhaust means is constructed out of essentially non-corrosive material to prevent damage to said exhaust means from products formed during the condensation of the exhausted effluent.

15. Apparatus as defined in claim 13 having collecting means to collect and remove products formed during the condensation of the exhausted effluent from said exhaust means.

16. Apparatus as defined in claim 1 wherein said emitter means is a tube which is internally divided to define said loop.

17. Apparatus as defined in claim 16 wherein said emitter tube comprises an internal baffle.

18. Apparatus as defined in claim 1 wherein said emitter means is coated with a material which alters the emissivity thereof.

* * * * *